US007845970B2

(12) United States Patent
Stromiedel

(10) Patent No.: US 7,845,970 B2
(45) Date of Patent: Dec. 7, 2010

(54) ELECTRICAL CONNECTOR

(75) Inventor: Konrad Stromiedel, Sondershausen (DE)

(73) Assignee: WAGO Verwaltungsgesellschaft mbH (DE)

( * ) Notice: Subject to any disclaimer, the term of this patent is extended or adjusted under 35 U.S.C. 154(b) by 0 days.

(21) Appl. No.: 12/720,812

(22) Filed: Mar. 10, 2010

(65) Prior Publication Data

US 2010/0190386 A1 Jul. 29, 2010

Related U.S. Application Data

(62) Division of application No. 11/789,445, filed on Apr. 24, 2007, now Pat. No. 7,704,095.

(30) Foreign Application Priority Data

Apr. 25, 2006 (DE) ..... 10 2006 019 655

(51) Int. Cl.
*H01R 4/24* (2006.01)

(52) U.S. Cl. ..... 439/441; 439/436

(58) Field of Classification Search ..... 439/441, 439/436, 437–440, 835
See application file for complete search history.

(56) References Cited

U.S. PATENT DOCUMENTS

2002/0187670 A1* 12/2002 Cisey ..... 439/441
2005/0042912 A1* 2/2005 Drewes et al. ..... 439/441

* cited by examiner

*Primary Examiner*—Hien Vu
(74) *Attorney, Agent, or Firm*—Salter & Michaelson

(57) ABSTRACT

The invention relates to an electrical connector for connecting a contact pin to an electrical conductor. It is proposed that the insulator housing of the connector provide a connecting space, in which the contact pin and the electrical conductor can be plugged in opposite direction in roughly parallel alignment and overlap by their axial lengths, the conductor being able to move crosswise to its conductor axis within a range of movement permitted by the construction and the leaf springs of the conductor clamp connection pressing the conductor in the direction of the contact pin.

15 Claims, 4 Drawing Sheets

ELECTRICAL CONNECTOR

BACKGROUND OF THE INVENTION

The invention relates to an electrical connector having an insulator housing, which has plug-in openings on two oppositely-lying sides of the housing, namely, on one side for inserting an electrical contact pin and on the other side for inserting the insulation-stripped end of at least one electrical conductor. On the pin side, the connector has a pin clamp contact, so that the connector can be plugged onto the contact pin of a circuit board or onto the connecting contact pin of another mating contact; and on the conductor side, the connector has a leaf-spring clamp connection with a leaf spring for each electrical conductor to be connected, which extends in the conductor plugging-in direction and oblique to the electrical conductor and, with its leaf spring end, firmly clamps the insulation-stripped end of the plugged-in electrical conductor.

Electrical conductors of this type were already described in 1976 in GB 1,528,993. There, they are presented as two-pole connectors, consisting of two one-pole connectors, which are arranged in a common block housing made of an insulator, so that the two-pole block housing connectors may be understood as a "plug and socket arrangement" in relation to two parallelly-positioned contact pins. According to GB 1,528,993, socket clamp contacts are provided for plugging the connector onto the contact pins and are to be designed in such a way that, if need be, the connector can be again pulled off the contact pins. It is also provided that the leaf-spring clamp connections present on the other side of the connector can also be again opened for the electrical conductors if need be by using a tool to press back the leaf springs of the leaf-spring clamp connections, so that the electrical conductors can be pulled out again from the connector.

Another connector of this type is known from EP 0 735 616 A2 (see therein FIGS. 18 and 19). It is referred to as an "electrical plug connector," which can be plugged onto the soldered contact pins of a circuit board and, in consequence of a tulip-shaped spring-back socket clamp contact, can be again pulled off the contact pins. Present on the other side of the connector, in turn, is a leaf-spring clamp connection for the electrical conductor, which is also designed as a releasable leaf-spring clamp connection (as in GB 1,528,993).

Both of the aforementioned connectors assume that their pin clamp contacts and their conductor clamp connections are fabricated in their entirety from one piece of spring steel sheet, the piece of spring steel sheet being shaped on the pin side to produce a socket clamp contact and forming on the conductor side an integrated leaf-spring clamp connection for the electrical conductor. Between the two sides, the piece of spring steel sheet takes on the current-conducting function, so that, in choosing the material, attention must be paid also to a useful current-conducting capacity of the spring steel sheet, which, in turn, is reflected in the material costs of the spring steel sheet.

In regard to the design of their construction, the two aforementioned connectors are designed in such a way that the pin clamp contact, on the one hand, and the conductor clamp connection, on the other hand, are arranged at an adequate distance apart, so that the two sides do not mutually interfere with each other. The insulator housings of these known connectors are to be accordingly large in dimension.

The problem of the invention is to create a connector of the type mentioned above, which can be produced cost-effectively and the size of which can be substantially reduced, so that it can also be employed in narrow spaces both as a one-pole and as a multipole connector.

SUMMARY OF THE INVENTION

This problem is solved in accordance with the invention by having the insulator housing of the connector provide a connecting space for each electrical conductor to be connected, into which the contact pin and the electrical conductor can be plugged adjacently in roughly parallel alignment, the contact pin and the electrical conductor overlapping in their axial lengths. In doing so, the contact pin is held in fixed position in the connecting space, whereas the electrical conductor can move crosswise to its conductor axis within a range of movement permitted by the construction (preferably, it can move parallel), whereby the leaf-spring end of the leaf-spring clamp connection is adjacent to that side of the electrical conductor that lies opposite the contact pin, so that the clamping force of the leaf spring presses the electrical conductor in the direction of the contact pin.

There are two fundamental embodiments of the connector in accordance with the invention.

In the first embodiment, the electrical conductor contacts the contact pin directly, so that this embodiment requires no additional current-conducting material between the electrical conductor and the contact pin for purposes of current conduction. This reduces cost and saves material. This embodiment of the connector is preferred for single-wire, solid electrical conductors, because these can be inserted into the connecting space of the connector without prior opening of the leaf-spring clamp connection.

The second embodiment of the new connector is preferably recommended for multiwire flexible electrical conductors, in which, in the conventional way, the leaf-spring clamp connection can be opened before the flexible conductor is inserted into the connecting space of the connector. This embodiment of the connector has the special feature that a contact wall is positioned between the electrical conductor and the contact pin in the region of their mutual axial overlap and this wall guides the electrical conductor in the direction of its conductor axis into the connecting space during the plugging-in operation and does so, namely, preferably all the way into a bottom-side conductor catch recess that is open toward the contact wall. This contact wall guide prevents the undesired splicing of individual wires of a multiwire flexible conductor. The contact wall can move in the direction of the contact pin, jointly with the electrical conductor, within a range of movement permitted by the construction crosswise to the conductor axis of the electrical conductor, so that the electrical conductor contacts the contact wall directly and the contact wall contacts the contact pin directly.

A connector having the above features can be produced extremely cost-effectively. For the new connector, only a small piece of spring steel sheet has to be used—namely, exclusively for the formation of the leaf-spring clamp connection. The needed materials required for this can be substantially reduced, especially when the leaf spring of the leaf-spring clamp connection is propped against the insulator housing of the connector. In this regard, it is proposed that the leaf-spring clamp connection has a U-shaped, bent, two-arm leaf spring, which has a leaf-spring clamp arm and a leaf-spring retaining arm, the leaf-spring retaining arm being held in position in the insulator housing of the connector by engaging with the insulator housing.

In regard to the required reduction in the size of construction of the connector, the teaching of the invention includes the fact that the axial lengths of the contact pin and of the electrical conductor to be plugged into the connector overlap. This overlap may be maximal in that the electrical conductor is inserted into the connecting space all the way to a bottom-side closing wall, so that the end of the electrical conductor can be guided near to the foot end of the electrical contact pin or of another connecting pin. This maximum overlap enables the height of construction of the connector to not be substantially greater than the plugging-in depth of the electrical conductor.

The new connectors may have one or two connecting spaces for electrical conductors per pole, only one contact pin being sufficient for one connector with two connecting spaces, when this pin is positioned in the middle between the connecting spaces and serves both connecting spaces as a contact pin.

The connectors in accordance with the invention can, in principle, be plugged onto any contact pin and/or connecting pin used in practice. It is preferred that the head end of the respective contact pin be fixed in precise position by way of an insulator overhang. This positional precision of the respectively used contact pin improves the contact seating of the electrical conductor at the contact pin.

The same purpose of positional precision of the contact pin is attained, wherein the foot end of the contact pin is held in fixed position against the insulator housing of the connector by means of a lateral support.

The contact pins, held in precise and fixed position in the insulator housing of the connector may, as desired by the post-processing industry, be plugged into the respective connecting spaces of the connector by the factory manufacturing the new connectors, so that, then, the post-processing industry can insert and solder the connectors with the foot-side projecting contact pins directly into, for example, the solder openings of a circuit board.

It is advantageous to use contact pins that are constructed, below their head end, with a convexity, the apex of which extends crosswise to the lengthwise axis of the contact pin. In connection with a contact line of an electrical conductor running in the direction of the lengthwise axis of the contact pin, there then results, at the point of intersection of the lines mentioned, a point-like physical contact having a higher specific surface pressure, which improves the current transfer at this point of contact.

DESCRIPTION OF THE DRAWINGS

Embodiment examples of the invention will be described below on the basis of drawings. Shown are.

DETAILED DESCRIPTION

Figure 1:
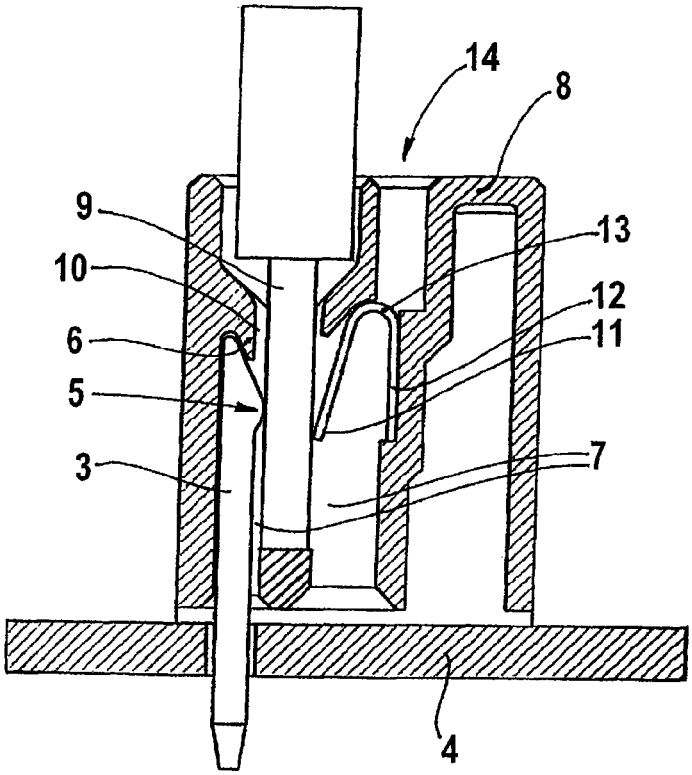
FIGS. 1+2 a first embodiment example of a connector in accordance with the invention, FIGS. 3-5 three further examples of embodiments, FIGS. 6-8 two embodiment examples having a catch to prevent the contact pin from being pulled out of the connector housing, FIGS. 9-15 two application examples of a connector in accordance with the invention.

FIG. 1 shows a cross section through a connector in accordance with the invention, which, namely, is in the state of being plugged onto a contact pin 3, which is soldered in the circuit board 4. The contact pin 3 has the convexity 5 and is positioned precisely in the connecting space 7 of the insulator housing 8 by means of the insulator overhang 6.

The electrical conductor 9 is plugged from the top side into the connector. Arranged adjacently in the connecting space 7 of the connector are the contact pin 3 and the electrical conductor 9, their axial lengths mutually overlapping. By means of the convexity 5, the contact pin contacts the electrical conductor 9 directly, so that a direct current transfer takes place between the contact pin and the electrical conductor.

The electrical conductor 9 can move (as the housing depiction in FIG. 1 shows) toward the left against the contact pin 3 by means of the spring force (clamping force) of the leaf spring 11. The movement takes place within the range of movement 10 permitted by the construction. This ensures that the electrical conductor always lies in secure contact against the respectively used contact pin.

The leaf spring mounted to the connector is fabricated in a U shape from one piece of spring steel sheet and has a leaf spring clamping arm 11 and a leaf-spring retaining arm 12. It is held in fixed position in the insulator housing with its head arch 13 and its retaining arm 12.

Provided in the insulator housing of the connector, in the conventional way, is an inspection opening 14. It is also possible to furnish the insulator housing with a press latch made of an insulator, which can be operated manually, if need be, in order to press the leaf-spring clamping arm 11 off the electrical conductor 9, so that the clamping of the electrical conductor is released and the electrical conductor can be pulled out of the connector. The same result is also usually accomplished by using an actuating opening in the insulator housing, through which a tool (e.g., a screwdriver bit) can be inserted to reach the leaf-spring clamping arm 11, as is also depicted, for example, in FIG. 3.

Figure 2:
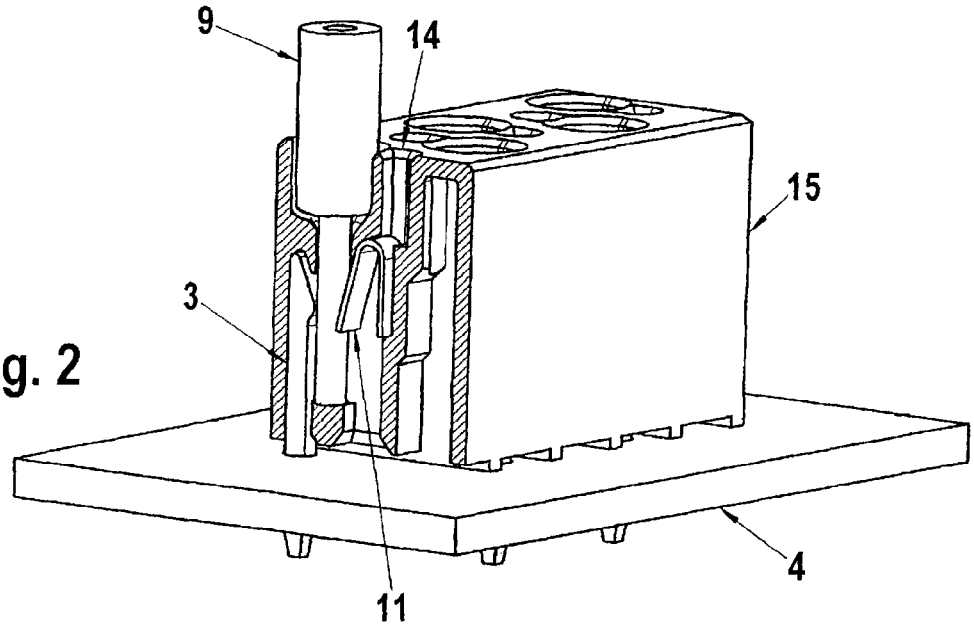

FIG. 2 shows, in a perspective view, a multipole connector of the type in accordance with the invention, having a block housing 15 fabricated from an insulator. The total of five one-pole connectors mounted in the block housing are identical in construction and each corresponds to the embodiment example according to FIG. 1. They are oriented alternately in relation to one another. This arrangement scheme saves space, but it may also be replaced by any other desired arrangement scheme.

Figure 3:
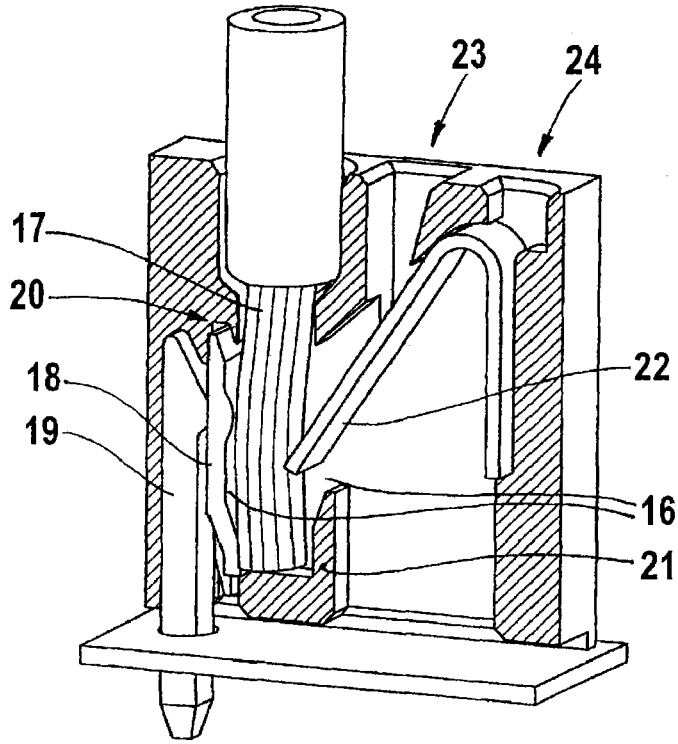

FIG. 3 shows the perspective cross section of a one-pole connector in accordance with the invention, having a connecting space 16 that has special features for the connection of a multiwire flexible conductor 17. The connecting space terminates on its left side at a contact wall 18, which is positioned between the flexible conductor 17 and the contact pin 19 and can move in a range of movement 20 permitted by the construction crosswise to the conductor axis of the electrical conductor 17 and jointly with it in the direction of the contact pin 19 in order to ensure a good electrical contact between the contact pin, the contact wall, and the flexible conductor. The contact wall 18 guides the flexible conductor during the plugging-in operation all the way into a bottom-side conductor catch recess 21, which is open toward the contact wall, thereby preventing individual wires from being spliced from the multiwire flexible conductor 17 during the plugging-in operation. The conductor clamping site between the leaf spring 22 and the contact wall 18 can be opened for connecting and releasing the electrical conductor by inserting a screwdriver bit via the actuating opening 23 into the connecting space and moving the leaf spring away from the electrical conductor by using the screwdriver bit. The conventional inspection opening is provided by reference 24.

Figure 4:
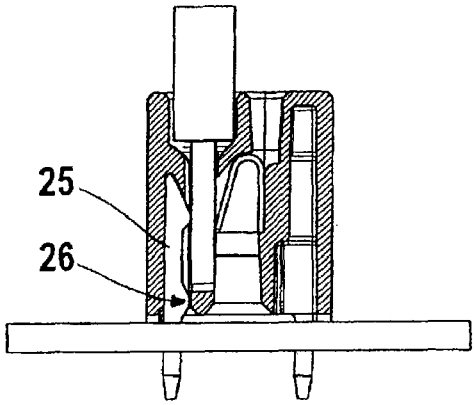

FIG. 4 shows a connector that is comparable to the connector according to FIG. 1, but in which the contact pin 25 plugged into the connecting space has a bottom support 26, which is oriented toward the insulator housing of the connector and improves the positional precision of the contact pin in the connecting space.

Figure 5:
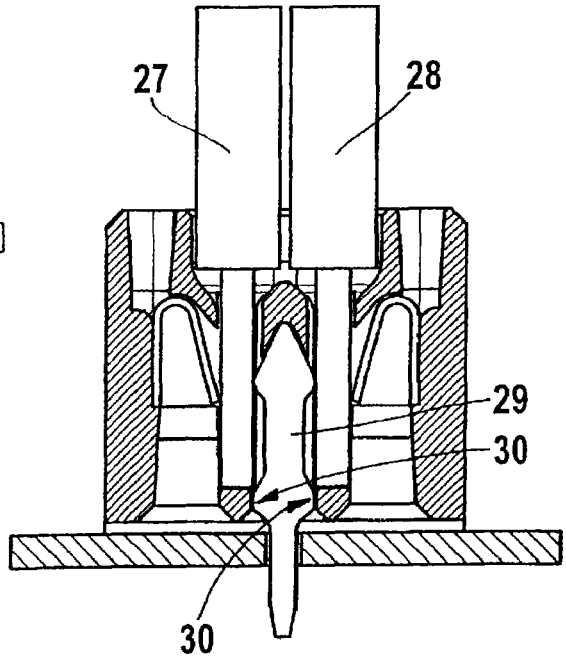

FIG. 5 shows, in cross section, a one-pole connector in accordance with the invention, which has two connecting spaces for two electrical conductors 27 and 28 and can be plugged onto only one contact pin 29 for producing an electrical connection. The contact pin 29 is constructed mirror-symmetrically with respect to its lengthwise axis and thus serves both connecting spaces as the contact pin. It has on both sides, respectively, a support 30, which ensures the positionally precise plugging of the connector onto the contact pin.

As a rule, the connectors are plugged onto the contact pin of a circuit board or onto the connecting contact pin of another mating contact (for example, to an electrical device). This can be conducted, as desired, before or after the connection of the electrical conductor to the connector. If need be—for example, in the event of a defect of a component wired to the connector—it is advantageous in terms of technical operation to pull the connector out from the contact pins and to replace the complete component group (for example, consisting of the defective component and the connector wired to the component) with a new component group.

In practice, there are also many cases of application for the new connectors, in which it is required that the connectors are not permitted to be pulled off of the contact pins; that is, a pull-out detent is to be present for the contact pin, so that the pin cannot be pulled out of the connecting space of the connector. This is depicted in FIGS. 6 to 8.

Figure 6:
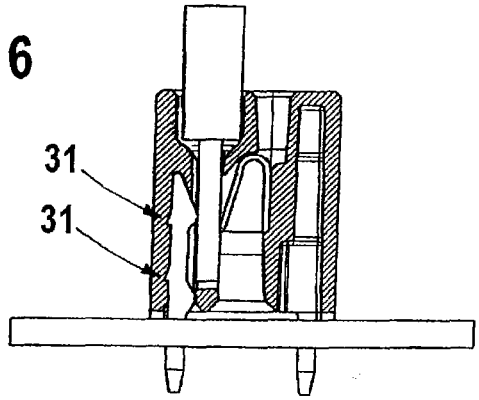

FIG. 6 shows a connector that is comparable to the embodiment example according to FIG. 4, but, in addition, has a pull-out detent for the contact pin, which, in this embodiment example, acts in the form of the barbed locking pieces 31 in the corresponding recesses of the insulator housing of the connector.

Figure 7:
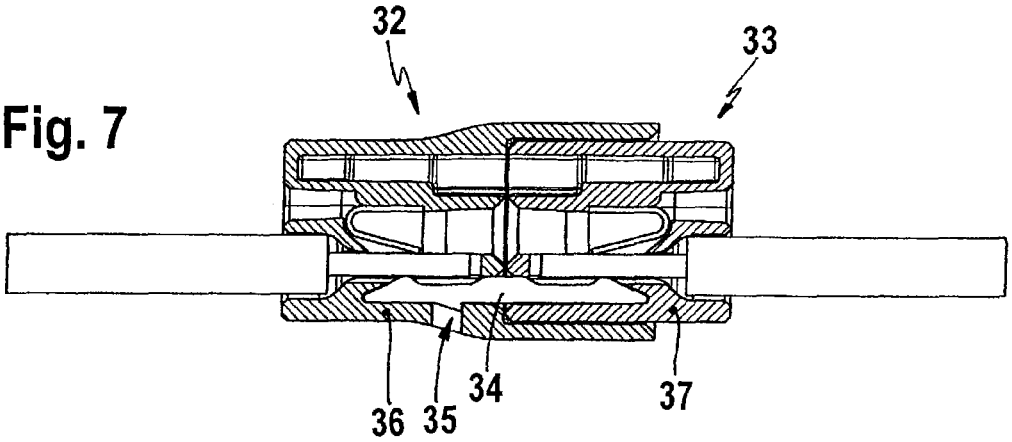
Figure 8:
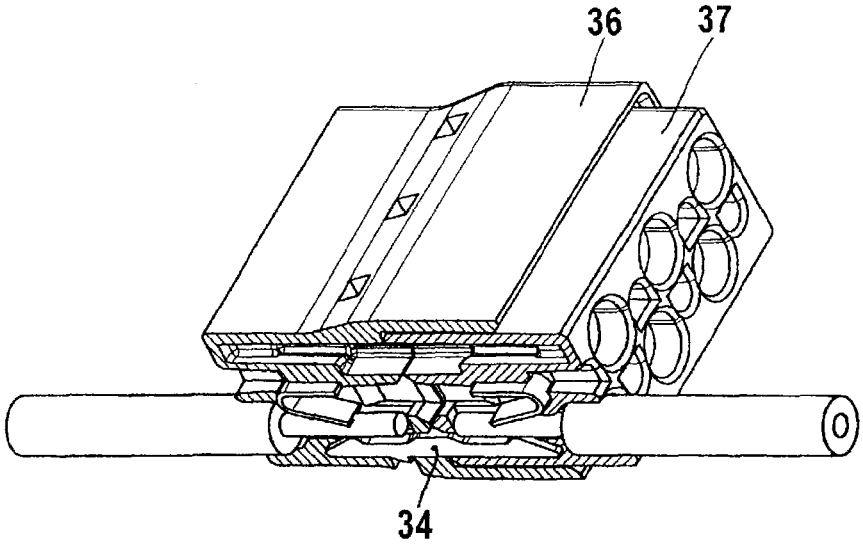

FIGS. 7 and 8 show two connectors, the insulator housings of which are constructed and formed in such a way that both connectors can be used jointly as an electrical plug connection. In their basic construction, the connectors 32 and 33 are comparable to the embodiment example according to FIG. 4, although, for the connector 32 depicted on the left, the contact pin 34 (which is common to both connectors) is fixed in place in the insulator housing 36 by use of a pull-out detent 35, whereas, in the connector 33 depicted on the right, the insulator housing 37 can be pulled off of the contact pin 34 (which is common to both connectors) and the electrical plug connection that is shown can thereby be opened.

FIGS. 9 to 15 show two application examples for a connector according to the teaching of the invention in order to demonstrate that these can be used very well also for plug-in linking connectors that can be plugged onto angled contact pins, which, in turn, are soldered into a circuit board.

Figure 11:
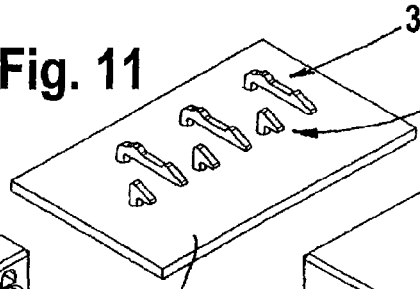

FIG. 11 shows a circuit board 38 into which, in an offset arrangement, a long angled contact pin 39 and a short angled contact pin 40 are respectively soldered, the offset arrangement ensuring that the soldering sites of the contact pin in the circuit board 38 have an adequate, that is, interference-free, distance from one another.

Figure 9:
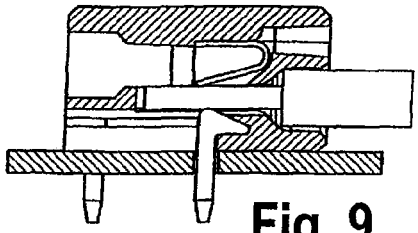
Figure 10:
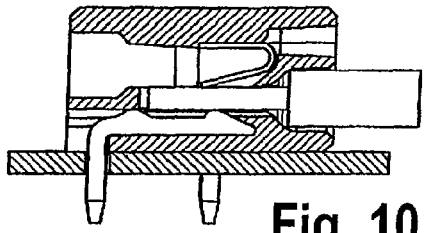
Figure 13:
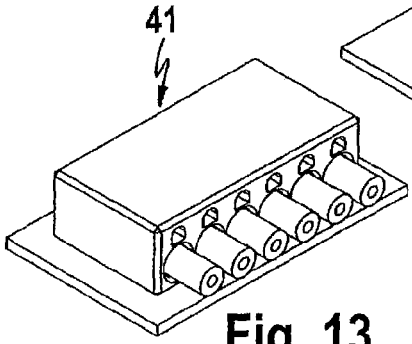
Figure 12:
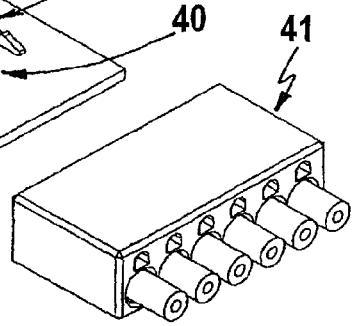

The connectors that can be plugged onto the angled contact pins are depicted in cross section in FIG. 9 and FIG. 10. FIG. 12 and FIG. 13 show the connectors as 6-pole connectors 41 in a common insulator block housing. FIG. 11 and FIG. 12 show the 6-pole connector 41 prior to being plugged onto the angled contact pins of the circuit board 38. FIG. 13 shows the same 6-pole connector after the plugging operation.

Figure 15:
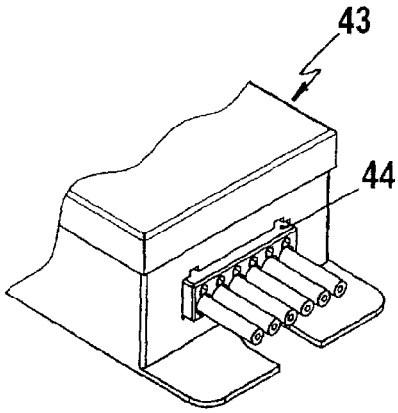
Figure 14:
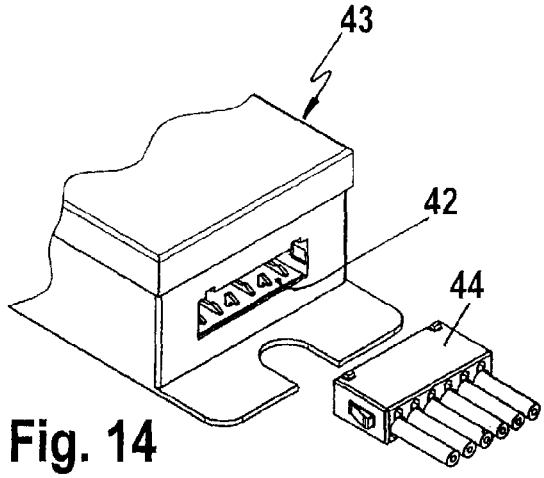

FIG. 14 shows a circuit board 42 having angled contact pins (corresponding to the circuit board 38 in FIG. 11), which is mounted in the housing of a lamp ballast 43 for electrical lamps in such a way that the 6-pole connector 44 in accordance with the invention can produce, without any problems and in a single plugging operation, all required conductor connections to the lamp ballast and to the lamp (see FIG. 15).

What is claimed is:

1. An electrical connector comprising, an insulator housing, which has plug-in openings on two oppositely-lying sides of the housing, namely, on a first side for inserting an electrical contact pin and on a second side for plugging in the insulation-stripped end of at least one electrical conductor, and a leaf spring for each electrical conductor to be connected, which extends in a conductor plugging-in direction and oblique to the electrical conductor and, with the leaf spring, firmly clamps the insulation-stripped end of the plugged-in electrical conductor, wherein the insulator housing of the connector provides a connecting space for each electrical conductor to be connected, into which the contact pin and the electrical conductor can be plugged in adjacent to one another in roughly parallel alignment, the contact pin and the electrical conductor overlapping in the respective axial lengths of the contact pin and electrical conductor, wherein the contact pin is held in fixed position in the connecting space, whereas the electrical conductor can move crosswise to a conductor axis of the electrical conductor within a range of movement, wherein a leaf-spring end of the leaf-spring is adjacent to the side of the electrical conductor that lies opposite the contact pin, so that the clamping force of the leaf spring presses the electrical conductor in the direction of the contact pin, and a conductive contact wall positioned parallel and along between the electrical conductor and the contact pin where the contact pin and electrical conductor overlap along the respective axial lengths thereof, said conductive contact wall guides the electrical conductor in the direction of the conductor axis of the electrical conductor during the plugging-in operation into the connecting space, whereby the contact wall can move in the direction of the contact pin, jointly with the electrical conductor, within a range of movement crosswise to the conductor axis of the electrical conductor, so that the electrical conductor electrically contacts the contact wall directly and the contact wall electrically contacts the contact pin directly.

2. The connector according to claim 1, wherein the head end of the contact pin is held in a positionally precisely fixed position in the insulator housing of the connector by way of a insulator overhang.

3. The connector according to claim 1, wherein the foot end of the contact pin is held in fixed position against the insulator housing of the connector by means of a lateral support.

4. The connector according to claim 1, wherein the contact pin comprises a head end, and a convexity below the head end of the electrical contact pin, an apex of the convexity of which extends crosswise to a lengthwise axis of the contact pin, said apex projects in the direction of the electrical conductor to be connected, and the leaf-spring end of the leaf-spring lies against the electrical conductor at roughly the height of the convexity.

5. The connector according to claim 1, wherein the leaf-spring includes a U-shaped, bent, two-arm leaf spring, which has a leaf-spring clamp arm and a leaf-spring retaining arm, and the leaf-spring retaining arm is held in fixed position in the insulator housing of the connector by engaging with the insulator housing.

6. An electrical connector comprising:

an insulator housing having oppositely disposed openings;

an electrical contact pin supported from a circuit board and received in one of the openings;

an electrical connector received in the other of the openings;

a leaf spring for each electrical conductor to be connected, which extends oblique to the electrical conductor and firmly clamps the electrical conductor;

wherein the insulator housing of the connector provides a connecting space for each electrical conductor to be connected, into which the contact pin and the electrical conductor can be plugged in adjacent to one another in substantially parallel alignment, the contact pin and the electrical conductor overlapping in the respective axial lengths of the contact pin and electrical conductor;

wherein the contact pin is held in fixed position in the connecting space, whereas the electrical conductor can move transverse to a conductor axis of the electrical conductor;

and wherein the leaf-spring has an end that is disposed adjacent to a side of the electrical conductor that lies opposite the contact pin, so that the clamping force of the leaf spring presses the electrical conductor in the direction of the contact pin;

and a conductive contact wall positioned parallel and along between the electrical conductor and the contact pin where the contact pin and the electrical conductor overlap along the respective axial lengths thereof, said conductive contact wall guides the electrical conductor in the direction of the conductor axis of the electrical conductor during the plugging-in operation into the connecting space; whereby the contact wall can move in the direction of the contact pin, jointly with the electrical conductor, within a range of movement crosswise to the conductor axis of the electrical conductor, so that the electrical conductor electrically contacts the contact wall directly and the contact wall electrically contacts the contact pin directly.

7. The connector according to claim 6 wherein the head end of the contact pin is held in a positionally precisely fixed position in the insulator housing of the connector by way of a insulator overhang.

8. The connector according to claim 6 wherein the foot end of the contact pin is held in fixed position against the insulator housing of the connector by means of a lateral support.

9. The connector according to claim 6 wherein the contact pin has, below the head end thereof, a convexity, the apex of which extends crosswise to a lengthwise axis of the contact pin and which projects in the direction of the electrical conductor to be connected, and the leaf-spring end of the leaf-spring lies against the electrical conductor at roughly the height of the convexity.

10. The connector according to claim 6 wherein the leaf-spring includes a U-shaped, bent, two-arm leaf spring, which has a leaf-spring clamp arm and a leaf-spring retaining arm, and the leaf-spring retaining arm is held in fixed position in the insulator housing of the connector by engaging with the insulator housing.

11. An electrical connector comprising:

an insulator housing having oppositely disposed openings;

an elongated electrical contact pin, having a substantially uniform width, and received in one of the openings;

said electrical contact pin supported in the insulator housing so as to be both insertable into and removable from the insulator housing;

an electrical conductor having an insulation-stripped end received in the other of the openings and having an electrical conductor axis and a width;

said electrical conductor supported in the insulator housing so as to be both insertable into and removable from the insulator housing;

a leaf spring for each electrical conductor to be connected, fixedly supported in the insulator housing, which extends oblique to the electrical conductor and firmly clamps the electrical conductor against the electrical contact pin;

wherein the insulator housing of the electrical connector provides a connecting space for each electrical conductor to be connected, into which the electrical contact pin and the electrical conductor can be plugged in adjacent to one another in substantially parallel alignment, wherein an axial length of the electrical contact pin and the electrical conductor are overlapping each other;

wherein the electrical contact pin, once inserted, is held in fixed position in the connecting space, whereas the electrical conductor, once inserted can move transverse to the electrical conductor axis;

and a conductive contact wall positioned parallel and along between the electrical conductor and the electrical contact pin;

and wherein the contact wall is positioned where the contact pin and electrical conductor overlap, said contact wall to guide the electrical conductor in the direction of the conductor axis during the plugging-in operation into the connecting space, whereby the conductive contact wall can move in the direction of the contact pin, jointly with the electrical conductor, within a range of movement crosswise to the conductor axis of the electrical conductor, so that the electrical conductor electrically contacts the contact wall and the contact wall electrically contacts the contact pin.

12. The connector according to claim 11 wherein the leaf spring has a leaf spring retaining arm held in fixed position in the insulator housing and a leaf spring clamping arm that is disposed adjacent to a side of the electrical conductor that lies opposite the electrical contact pin, so that the clamping force of the leaf spring presses the electrical conductor in a direction of the electrical contact pin.

13. The connector according to claim 11 wherein the leaf spring, when the electrical contact pin and electrical conductor are both inserted, is disposed spaced laterally from the electrical contact pin, and the leaf spring clamping arm contacts and presses against the electrical conductor at a contact location, and with the leaf spring clamping arm at the contact location spaced from the electrical contact pin by substantially the width of the insulation-stripped end.

14. The connector according to claim 11 wherein, once the electrical connector is assembled and the electrical contact pin and electrical conductor are engaged with the insulator housing, the leaf spring is disposed in the insulator housing positionally independent of the electrical contact pin and in engagement with the electrical conductor.

15. The connector according to claim 11 wherein the leaf spring engages the electrical conductor but without any direct engagement between the leaf spring and electrical contact pin.

* * * * *